US005781827A

United States Patent [19]

Shimada et al.

[11] Patent Number: 5,781,827

[45] Date of Patent: Jul. 14, 1998

[54] DEVELOPING DEVICE HAVING A BIAS-CONTROLLED TONER DISCHARGING MEMBER

[75] Inventors: Hirokatsu Shimada; Tateki Oka, both of Toyohashi, Japan

[73] Assignee: Minolta Co., Ltd., Osaka, Japan

[21] Appl. No.: 700,941

[22] Filed: Aug. 21, 1996

[30] Foreign Application Priority Data

Aug. 22, 1995 [JP] Japan ..... 7-213709
Jul. 5, 1996 [JP] Japan ..... 8-176118

[51] Int. Cl.[6] ..... G03G 15/06

[52] U.S. Cl. ..... 399/55; 399/284

[58] Field of Search ..... 399/55, 53, 283, 399/284, 285

[56] References Cited

U.S. PATENT DOCUMENTS 4,745,429 5/1988 Mukai et al. ..... 399/283
5,473,417 12/1995 Hirano ..... 399/285
5,568,236 10/1996 Toda et al. ..... 399/285
5,592,265 1/1997 Sakuraba et al. ..... 399/285
5,600,419 2/1997 Sakuraba et al. ..... 399/285

FOREIGN PATENT DOCUMENTS 06-075469 3/1994 Japan .

*Primary Examiner*—Nestor R. Ramirez
*Attorney, Agent, or Firm*—McDermott, Will & Emery

[57] ABSTRACT

A toner discharging member is in contact with a developing sleeve at a position downstream to a developing region at which the developing sleeve (developer carrying member) confronts an electrostatic latent image carrier, extra toner returning to a toner supply region after the development is brought into contact with the discharging member and moves between the discharging member and the developing sleeve, a discharging bias voltage is applied to the toner discharging member, and the discharging bias voltage thus applied is controlled based on a toner charged state, an adhesion state of toner onto the electrostatic latent image carrier, a current flowing through a toner discharging member and others.

30 Claims, 9 Drawing Sheets

DEVELOPING DEVICE HAVING A BIAS-CONTROLLED TONER DISCHARGING MEMBER

BACKGROUND OF THE INVENTION

1. Field of the Invention

The present invention relates to image forming apparatuses such as a copying machine and a printer, and in particular to developing devices for developing and visualizing electrostatic latent images formed on electrostatic latent image carriers in the image forming apparatuses.

2. Description of the Related Art

Developing devices which are employed in electrophotographic image forming apparatuses such as a copying machine and a printer are classified into two types, i.e., one-component developing devices and two-component developing devices. The former uses one-component developer (toner), and the latter uses two-component developer (toner and carrier).

In the one-component developing device, toner which is supplied to a developer carrying member having a moving surface moves between the surface and a toner restricting member which is in contact with the surface, so that the charged toner is held in a form of a thin film on the surface and is transported to a developing region for development. Extra toner which was not used for development is held on the developer carrying member and is returned to a toner supply region.

In the one-component developing device thus constructed, however, the chargeability of the toner increases when the toner has an increased flowability, for example, in a low humidity environment, and therefore highly charged toner, which is not removed from the developer carrying member and is accumulated thereon, tends to increase in amount. In this case, the amount of toner attracted onto the developer carrying member increases, and the toner restricting member cannot sufficiently restrict the amount of toner adhering to the developer carrying member, so that an extraordinarily large amount of toner is transferred toward the electrostatic latent image carrier, resulting in a so-called abnormal toner adhesion, i.e., disadvantageous development of a non-image portion with the toner.

Since the toner accumulated on the developer carrying member is subjected many times to a stress applied by the toner restricting member, it is forcedly spread over and stuck on the developer carrying member to form a so-called filming of the toner. This impairs the image quality. Due to the above stress, the toner is liable to be deteriorated (reduction in particle diameter of toner, drop of fluidization agent or the like), so that a black-solid following property and others may be impaired.

When the toner accumulated on the developer carrying member increases in amount, new toner supplied to the carrying member is charged not only by the originally intended manner, i.e., by the toner restricting member but also by friction between toner particles. This may increase an amount of toner which is charged to a polarity opposite to that of the regular charged polarity, resulting in impairment of the image quality.

In order to overcome the above problems, such a manner has been proposed that the toner which is held by the developer carrying member and is being returned to a toner supply region is brought into contact with a toner discharging member which is in contact with the developer carrying member.

However, even in the case where the toner discharging member is employed, the following disadvantage is caused, if a constant potential is always applied to the toner discharging member. The charged quantity of toner, i.e., the quantity of charges which the toner bear may decrease, for example, after printing a certain number of sheets. Even in this case, the quantity of charges which are removed from the toner by the toner discharging member does not change remarkably. Therefore, a balance between charging and discharging is lost, and the excessive discharging produces the toner charged to the opposite polarity, which causes fogging on the image. Further, in the case where the toner restricting member is supplied with a bias potential of the same polarity as the chargeable polarity of the toner with respect to the developing bias potential, the toner restricting member attracts the toner of the opposite polarity. The attracted toner stays at the same position on the member, and frictional sliding operation to the toner is repetitively caused. Thereby, the toner melts and adheres to the toner restricting member in a solidified form. This impedes flow of the toner to the nip between the toner restricting member and the developer carrying member, which impairs the image quality.

For example, if a balance between charging and discharging of the toner is lost due to temperature/humidity environment, the charging may exceed the discharging performance. In this case, highly charged toner, which does not move away from the developer carrying member and is accumulated on the developer charging member, tends to increase in quantity. This impedes development of the latent image on the electrostatic latent image carrier to some extent. Also, such a disadvantage occurs that the toner attracted to the developer carrying member is spread over the developer carrying member due to a stress applied many times to the toner by the toner restricting member, so that so-called filming of the toner occurs and the image quality is impaired.

A design tolerance of the developing devices and a variation with time (creep) due to use of the developing devices may change the state of contact of the toner discharging member with the developer carrying member, so that an appropriate balance between charging and discharging of the toner is lost, which also causes the above problem.

SUMMARY OF THE INVENTION

An object of the invention is to provide an electrophotographic image forming apparatus, wherein extra toner, which was not consumed for development and is to be returned to a developing device, can be appropriately discharged in accordance with the charged state of the toner even if change occurs in the charged state of the toner due to an environment and/or printing, and thereby images of a good quality can be formed.

It is also an object of the invention to provide a developing device, wherein extra toner, which was not consumed for development and is to be returned to a developing device, can be appropriately discharged in accordance with the charged state of the toner even if change occurs in the charged state of the toner due to an environment and/or printing, and thereby electrostatic latent images can be developed into visual images of a good quality.

A further object of the invention is to provide a one-component developing device wherein toner supplied to a developer carrying member having a moving surface moves between the surface and a toner restricting member being in contact with the surface, so that charged toner is held in a form of a thin film on the surface and is transported to a developing region for development, and extra toner which was not used for development is held on the developer carrying member, and is returned to a toner supply region. More specifically, the object is to provide the one-component developing device, in which toner to be returned to the toner supply region is appropriately discharged in accordance with the charged state of the toner even if change occurs in the charged state due to an environment and/or printing, and thereby images of a good quality can be formed by suppressing problems such as image fogging, filming of the toner on the developer carrying member and sticking of the toner to the toner restricting member.

A still further object of the invention is to provide a one-component developing device wherein toner supplied to a developer carrying member having a moving surface moves between the surface and a toner restricting member being in contact with the surface, so that charged toner is held in a form of a thin film on the surface and is transported to a developing region for development, and extra toner which was not used for development is held on the developer carrying member, and is returned to a toner supply region. More specifically, the object is to provide the one-component developing device, in which toner to be returned to the toner supply region is appropriately discharged in accordance with the charged state of the toner even in such cases that change occurs in the charged state due to an environment and/or printing and that a design tolerance of the developing devices and a variation with time due to use of the developing devices change the state of contact of the toner discharging member with the developer carrying member, and thereby images of a good quality can be formed by suppressing problems such as image fogging, filming of the toner on the developer carrying member and sticking of the toner to the toner restricting member.

In order to achieve the above object, the invention provides an image forming apparatus for forming a toner image comprising:

means for accomodating toner therein;

means for holding an electrostatic latent image thereon;

means for charging the toner accomodated in the toner accomodating means;

means for developing the electrostatic latent image on the electrostatic latent image holding means by the toner charged by the toner charging means;

means for detecting a charged state of the toner; and means for changing the charged state of the toner according to the result of detection by the toner charged state detecting means.

The means for detecting the charged state of the toner may be means for detecting the charged state of the toner accomodated in the toner accomodating means, or may be means for detecting the charged state of the toner based on developed toner or a developed toner image.

In order to achieve the above object, the invention also provides a developing device comprising:

means for holding toner to develop an electrostatic latent image;

means for charging the toner held by the toner holding means;

means for applying a bias voltage to the toner held by the toner holding means;

means for judging a charged state of the toner; and means for changing the bias voltage in accordance with the result of judgement by the judging means.

The toner charged state judging means may be means for judging the charged state of the toner held by the toner holding means according to a developed toner image, or may be means for judging the charged state of the toner held by the toner holding means according to the held toner.

In order to achieve the above object, the invention further provides a developing device of a first type.

This developing device includes:

a developer carrying member opposed to an electrostatic latent image carrier in a developing region for developing an electrostatic latent image formed on the electrostatic latent image carrier, and being driven to move its surface;

a toner restricting member being in contact with the surface of the developer carrying member and being operable such that the toner supplied to the developer carrying member is passed between the moving surface of the carrying member and the toner restricting member for holding charged toner on the surface of the developer carrying member in a form of a thin film;

means for applying a developing bias voltage to said developer carrying member;

a toner discharging member being in contact with the surface of the developer carrying member at a position downstream to the developing region in a moving direction of the developer carrying member surface;

sensing means for sensing a charged state of the toner; and means for applying a discharging bias voltage to the toner discharging member in accordance with the result of sensing or detection by said sensing means, said developer carrying member being operable to hold and return residual toner not consumed by the development to a toner supply region for the developer carrying member.

According to the developing device of the first type, the rotating developer carrying member moves the extra toner after the development between the developer carrying member and the toner discharging member, which is in contact with the developer carrying member at the position downstream to the developing region, and returns the same toward the toner supply region while bringing the toner into contact with the toner discharging member.

When the extra toner moves between the toner discharging member and the developer carrying member, a static electricity is produced from a potential difference between the discharging bias voltage, which is applied from the discharging bias voltage applying means to the toner discharging member, and the developing bias voltage, which is applied to the developer carrying member. The toner is attracted by this static electricity to the toner discharging member, and is discharged by friction with the toner discharging member, so that the toner passed by the member can be easily separated from the developer carrying member at the toner supply region.

The discharging bias voltage applying means applies an appropriate discharging bias voltage to the toner discharging member in accordance with the charged state of toner sensed by the charged state sensing means, so that practical problems such as insufficient discharging and excessive discharging of the toner may not occur after the development.

If the negatively chargeable toner is used, the discharging bias voltage generally satisfies the relationship of VD1>VD2, where VD1 represents a value of the discharging bias voltage when the toner is in a certain charged state, VD2 represents a value of the discharging bias voltage when the charged potential of toner is lower than the above, positive change of the voltage is deemed as increase, and negative change of the voltage is deemed as decrease.

When the positively chargeable toner is to be used, a relationship of VD3<VD4 is established, where VD3 represents a value of the discharging bias voltage when the toner is in a certain charged state, VD4 represents a value of the discharging bias voltage when the charged potential of toner is lower than the above, positive change of the voltage is deemed as increase, and negative change of the voltage is deemed as decrease.

The discharging bias voltage applied to the toner discharging member is controlled in accordance with the charged state of the toner, whereby a balance is maintained between charging and discharging for performing appropriate discharging. Thereby, disadvantages such as image fogging, sticking of the toner onto the toner restricting member and filming of the toner on the developer carrying member are suppressed as compared with the conventional case where the discharging bias voltage of a constant value is applied, so that a stable toner thin layer can be formed on the developer carrying member, and images of a good quality can be formed.

In order to achieve the above object, the invention still further provides a developing device of a second type.

This developing device includes:

- a developer carrying member opposed to an electrostatic latent image carrier in a developing region for developing an electrostatic latent image formed on the electrostatic latent image carrier, and being driven to move its surface;
- a toner restricting member being in contact with the surface of the developer carrying member and being operable such that the toner supplied to the developer carrying member is passed between the moving surface of the carrying member and the toner restricting member for holding charged toner on the surface of the developer carrying member in a form of a thin film;
- a toner discharging member being in contact with the surface of the developer carrying member at a position downstream to the developing region in a moving direction of the developer carrying member surface;
- means for applying a discharging bias voltage to said toner discharging member;
- means for switching said discharging bias voltage; and
- means for determining a timing of switching of said discharging bias voltage and sending an instruction of switching of the discharging bias voltage to said discharging bias voltage switching means,
- said developer carrying member being operable to hold and return residual toner not consumed by the development to a toner supply region for the developer carrying member.

According to the developing device of the second type, the rotating developer carrying member moves the extra toner after the development between the developer carrying member and the toner discharging member, which is in contact with the developer carrying member at the position downstream to the developing region, and returns the same toward the toner supply side while bringing the toner into contact with the toner discharging member.

When the extra toner moves between the toner discharging member and the developer carrying member, a static electricity with respect to the developer carrying member is weakened by a potential difference between a discharging bias voltage, which is applied from the discharging bias voltage applying means to the toner discharging member, and the developing bias voltage, which is applied to the developer carrying member. Also, the toner is discharged by friction with the toner discharging member, so that the toner passed by the member can be easily separated from the developer carrying member at the toner supply region.

The discharging bias voltage applied from the discharging bias voltage applying means is switched according to the circumstances so as to discharge the toner appropriately.

This switching is performed as follows. The means for determining a timing of switching of the discharge bias voltage and sending the instruction of switching of the discharging bias voltage to the discharging bias voltage switching means determines the timing of switching of the discharging bias voltage according to the circumferences, and instructs the discharging bias voltage switching means to switch the discharging bias voltage, whereby the switching means switches the discharging bias voltage applied from the discharging bias voltage applying means. In this manner, an appropriate discharging bias voltage is applied to the toner discharging member so as to prevent charging to the opposite polarity by practically insufficient or excessive discharging of the extra toner after the development.

By switching the discharging bias voltage applied to the toner discharging member in an appropriate timing, a balance between charging and discharging of the toner is held for performing appropriate discharging. Thereby, disadvantages such as image fogging, sticking of the toner onto the toner restricting member and filming of the toner on the developer carrying member are suppressed as compared with the conventional case where the discharging bias of a constant value is applied to the toner discharging member, so that a stable toner thin layer can be formed on the carrying member, and images of a good quality can be formed.

The foregoing and other objects, features, aspects and advantages of the present invention will become more apparent from the following detailed description of the present invention and the accompanying drawings.

DESCRIPTION OF THE PREFERRED EMBODIMENTS

Developing Device of the First Type

Figure 1:
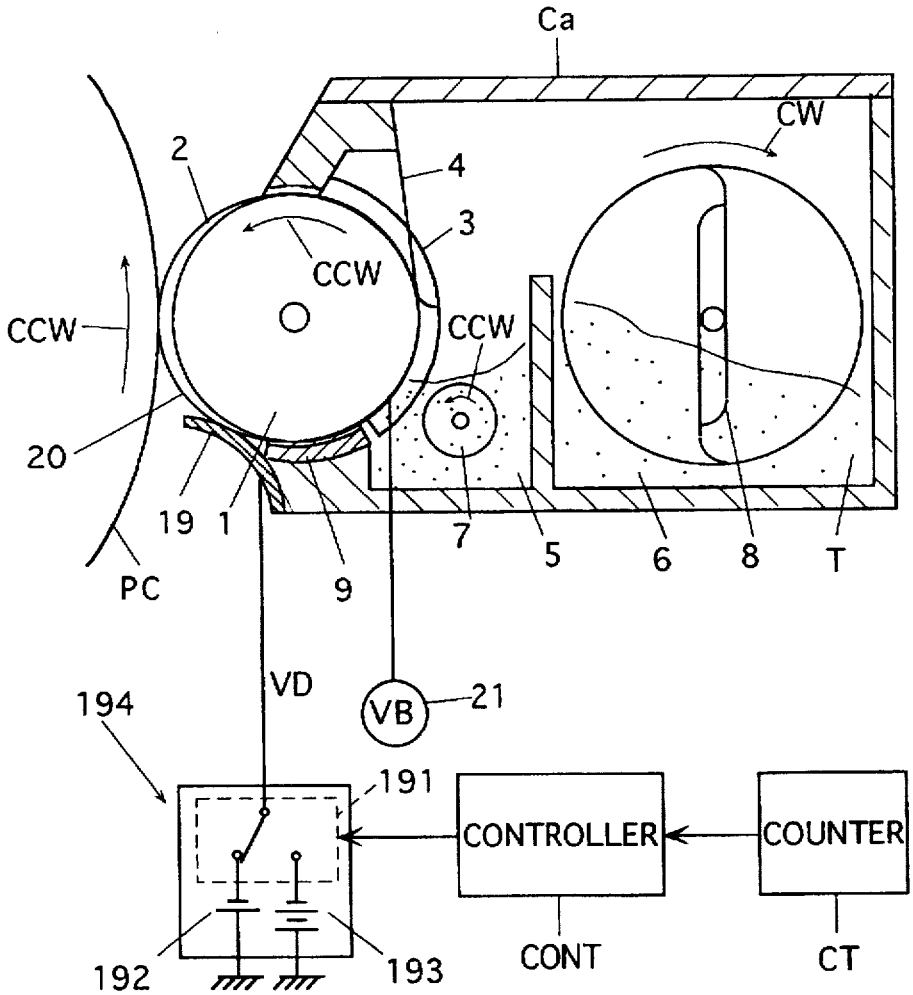
FIG. 1 is a schematic cross section of a one-component developing device of an embodiment of the invention.

The developing device of the first type will be described below more in detail.

The means for sensing the charged state of toner may be designed to measure directly a charge quantity of toner on the surface of the developer carrying member, or may be designed to sense indirectly the charged state of toner.

The sensing means for indirectly sensing the charged state of toner may be one of the following structures.

(1) The structure which includes a counter counting the number of sheets copied or printed by a copying machine, printing machine or the like, and is operable to sense the charged state of toner based on the number of the sheets counted by the counter. (2) The structure which includes an ampere meter monitoring a current flowing through the toner restricting member, and senses the charged state of toner based on the current value monitored by the ampere meter. (3) The structure which includes a humidity sensor measuring a humidity in a space accommodating the developing device, and senses the charged state of toner based on the value of humidity measured by the sensor. (4) The structure which includes a counter counting the number of printed sheets, an ampere meter monitoring a current flowing through the toner restricting member and a humidity sensor measuring a humidity as well as a conversion table in which predetermined combinations of the number of printed sheets, the value of current flowing through the toner restricting member and the humidity are written, the combinations representing the toner charged states corresponding to the combinations. In this sensing means, the toner charged state is determined based on the conversion table and the combination of the number of printed sheets counted by the counter, the current value monitored by the ampere meter and the humidity value measured by the humidity sensor.

If the means for sensing the toner charged state is one of those in the above items (1) to (3), the count of the counter, the current value monitored by the ampere meter or the humidity value measured by the humidity sensor is compared with a set number of the printed sheets, a set value of the current or a set value of the humidity, whereby the toner charged state is sensed in accordance with a magnitude of difference between them. The discharging bias applying means applies the discharging bias voltage to the toner discharging member based on the result of this sensing.

In this case, one or multiple set values may be used for each of the number of sheets, current value and humidity.

The toner charged state sensing means in the above item (4) corresponds to combination of the sensing means in the items (1) to (3). If this sensing means is employed, the means for applying the discharging bias voltage to the toner discharging member may have such a structure that it applies a discharging bias voltage to the toner discharging member based on the toner charged state sensed by the toner charged state sensing means and predetermined discharging bias voltages written in the conversion table corresponding to the predetermined combinations of the printed sheet number, the value of current flowing through the toner restricting member and the humidity.

The toner charged state sensing means in the above items (1) to (4) will be described below more in detail.

The toner charged state sensing means in the item (1) utilizing the counter is employed based on the following fact. When the number of printed sheets is small, i.e., in the initial state, the chargeability of the toner is superior to that after the printing of many sheets, and therefore the toner is charged to a higher extent by friction with the toner restricting member. However, the toner chargeability decreases as the number of prints increases.

As an example of the sensing means of this type, therefore, such a structure may be employed that the toner charged state is sensed based on whether or not the counter counts one or more cumulative sheet set numbers which are deemed as a boundary between different toner charged states.

The toner charged state sensing means in the above item (2), which utilizes the ampere meter monitoring the current flowing through the toner restricting member, operates based on the following fact that. For example, in a high-temperature and high-humidity environment, a larger current flows through the toner restricting member, and the charged quantity of toner passed by the toner restricting member decreases.

Accordingly, an example of the sensing means of this type may have such a structure that the toner charged state is sensed based on whether or not the ampere meter senses one or more current set values which are deemed as a boundary between different toner charged states.

The means for sensing the toner charged state utilizing the humidity sensor in the above item (3) operates based on the following fact. The toner in a low humidity environment has a good flowability and therefore has a good chargeability, but the toner in a high-humidity environment has a low flowability and allows flow of a larger current, which reduces the charge quantity of toner passed by the toner restricting member.

Accordingly, the sensing means of this type may have such a structure that the toner charged state is sensed based on whether or not the humidity sensor measures one or more humidity set values which are deemed as a boundary between different toner charged states.

The toner charged state sensing means in the above item (4) corresponds to the combination of the means in the above items (1) to (3), and the conversion table may be designed, for example, as follows.

In the table, there are recorded or written a first set value which is one cumulative set value of printed sheets forming a boundary between different toner charged states, a second set value which is one current set value forming a boundary between different toner charged states, and a third set value which is one humidity set value forming a boundary between different toner charged states. Further, in the table, one (e.g., first set value) of the first to third set values is combined with the others (e.g., second and third set values) in such a manner that each of a range lower than the first set value and a range not lower than the first set value are combined with the second and third set values, states lower than and not lower than the set value are determined for each of the second and third set values in each combination, and these states are combined together to form combinations of two stages including eight states.

This conversion table is represented as follows. In the following table, Cp represents a set value of cumulative printed sheet number, Hp represents a humidity set value, and Ip represents a current set value. C represents a printed sheet count of the counter, H represents a measured humidity by the humidity sensor, I represents a current value monitored by the ampere meter. DV1-VD8 represent discharging bias set voltages in the respective charged states.

| | H < Hp (% R/H) (High Charge) | H ≧ Hp (% RH) (Low Charge) |
|---|---|---|
| O ≦ C < Cp (High Charge) | | |
| I < Ip (μA) (High Charge) | VD1 (V) | VD3 (V) |
| I ≧ Ip (μA) (Low Charge) | VD2 (V) | VD4 (V) |
| Cp ≦ C (Low Charge) | | |
| I < Ip (μA) (High Charge) | VD5 (V) | VD7 (V) |
| I ≧ Ip (μA) (Low Charge) | VD6 (V) | VD8 (V) |

Preferred embodiments of the developing device of the first type according to the invention will be described below.

The developing devices shown in FIGS. 1 to 4 are one-component developing devices which perform reversal development with negatively chargeable toner.

Any of the developing devices is assembled in an electrophotographic image forming apparatus, and is opposed to an electrostatic latent image carrier (here, photosensitive drum) PC. The photosensitive drum PC is driven to rotate in a direction indicated by an arrow CCW in the figure, and its surface is uniformly charged by a charging device (not shown). Image exposing means (not shown) performs image exposure on the charged region to form an electrostatic latent image corresponding to an original image. The developing device develops this electrostatic latent image to form a toner image. This toner image is transferred onto transfer member by tranferring means (not shown), and subsequently is fixed by a fixing device (not shown).

Each developing device includes a drive roller 1, which is driven to rotate counterclockwise (i.e., in the direction indicated by an arrow CCW) in the figure by a drive unit (not shown). The drive roller 1 is fitted into a developing sleeve 2 (developer carrying member) having an inner diameter slightly larger than the outer diameter of the drive roller 1. The sleeve 2 is pushed at its opposite ends from the rear side by pressing guides 3 against the drive roller 1. A loose portion 20 of the sleeve 2, which is formed at the opposite side by the above pressing, is in flexible contact with the electrostatic latent image carrier (photosensitive drum) PC. A toner restricting blade 4 (toner restricting member) is in contact with the same side of the developing sleeve 2 as the pressing guides 3.

The drive roller 1, pressing guides 3, toner restricting blade 4 and others are arranged in a developing device casing Ca.

The developing sleeve 2 can be supplied with a developing bias voltage VB from a power supply 21.

At the rear side of the developing sleeve 2, there is arranged a buffer chamber 5, behind which a toner supply chamber 6 is arranged. A toner supply rotary member 7 rotating counterclockwise (CCW) in the figure is arranged in the buffer chamber 5, and a toner stirring and supply rotary member 8 rotating clockwise (CW) is arranged in the toner supply chamber 6. A lower seal member 9 is in contact with the lower surface of the developing sleeve 2 for preventing external leakage of toner T from the buffer chamber 5. The lower seal member 9 is made of a soft synthetic resin having an elasticity.

A toner discharging member 19 which is in contact with the developing sleeve 2 is arranged at a position between a developing region, in which the developing sleeve 2 confronts the photosensitive drum PC, and the lower seal member 9.

The toner discharging member 19 contains in a dispersed form a material having a good electrical conductivity, and has a surface made of a material, which is shifted from the toner to the same polarity side as the regular chargeable polarity of the toner on the frictional electricity series.

Figure 2:
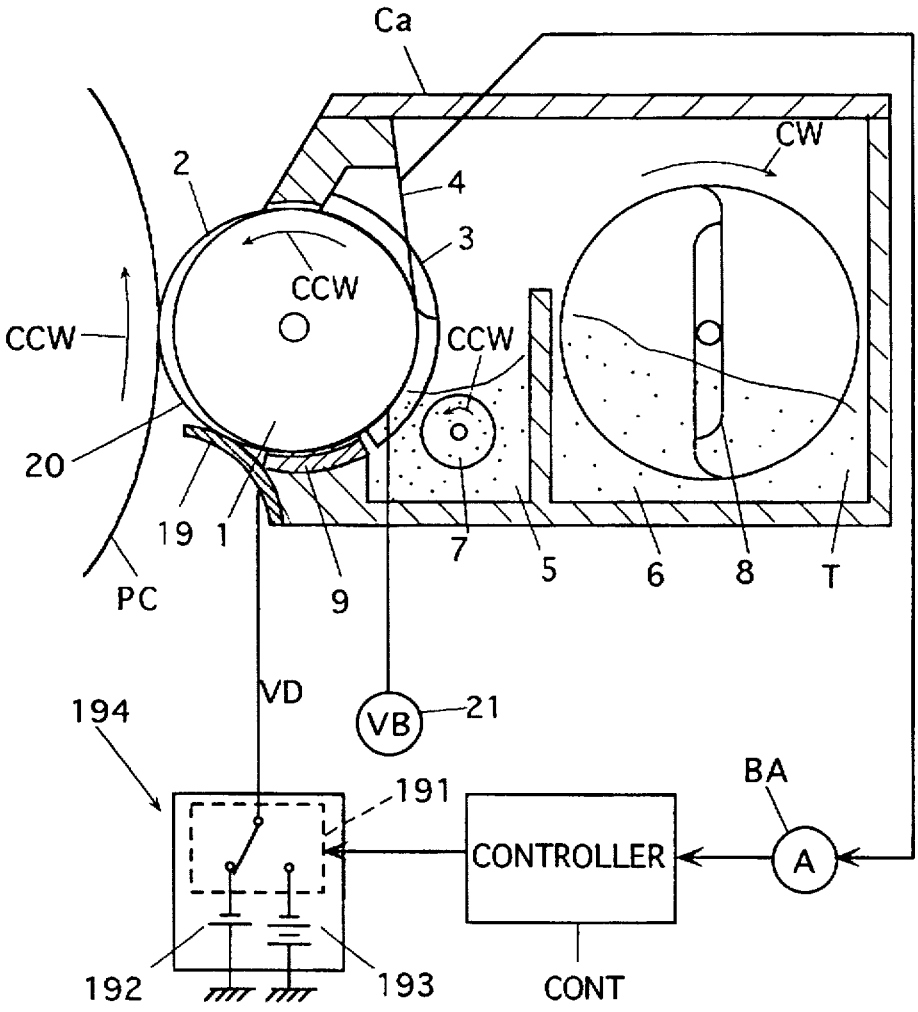
FIG. 2 is a schematic cross section of a one-component developing device of another embodiment of the invention.
Figure 3:
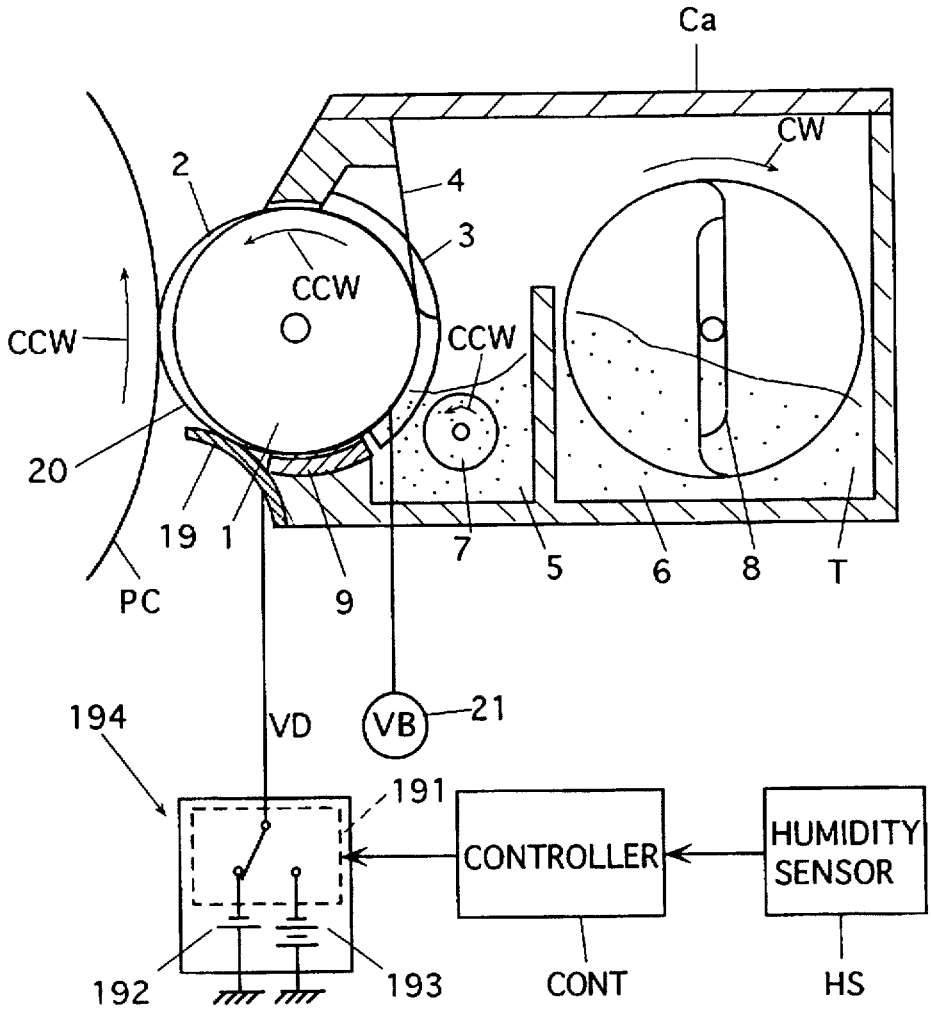
FIG. 3 is a schematic cross section of a one-component developing device of still another embodiment of the invention.

In each of the developing devices shown in FIGS. 1 to 3, the toner discharging member 19 is connected to a discharging bias voltage applying unit 194 which includes a switching portion 191 and discharging bias power supplies 192 and 193, and the switching portion 191 is connected to a controller CONT. The controller CONT is connected to a component of the means for sensing the charged state of toner T, and specifically is connected to a counter CT in the developing device in FIG. 1, an ampere meter BA monitoring a value of current flowing through the toner restricting member 4 in the developing device shown in FIG. 2 and a humidity sensor HS measuring a humidity in the developing device shown in FIG. 3. In accordance with an input signal from the above component, the controller CONT determines the toner charged state, and sends, to the switching portion 191, a signal for switching the discharging bias voltage VD corresponding to the toner charged state. In this manner, the discharging bias power supply 192 or 193 is selected. In each of the developing devices shown in FIGS. 1 to 3, the discharging bias voltages VD is selectively set to two values. However, it may be selectively set to three or more values.

In each of these embodiments, a voltage of the power supply 192 is −200 (V), and a voltage of the power supply 193 is −300 (V). When employing the counter CT, it is arranged at an appropriate position in the image forming apparatus equipped with the developing device according to the invention. When employing the humidity sensor HS, it is disposed at a position allowing sensing of the humidity in the space accommodating the developing device.

Figure 4:
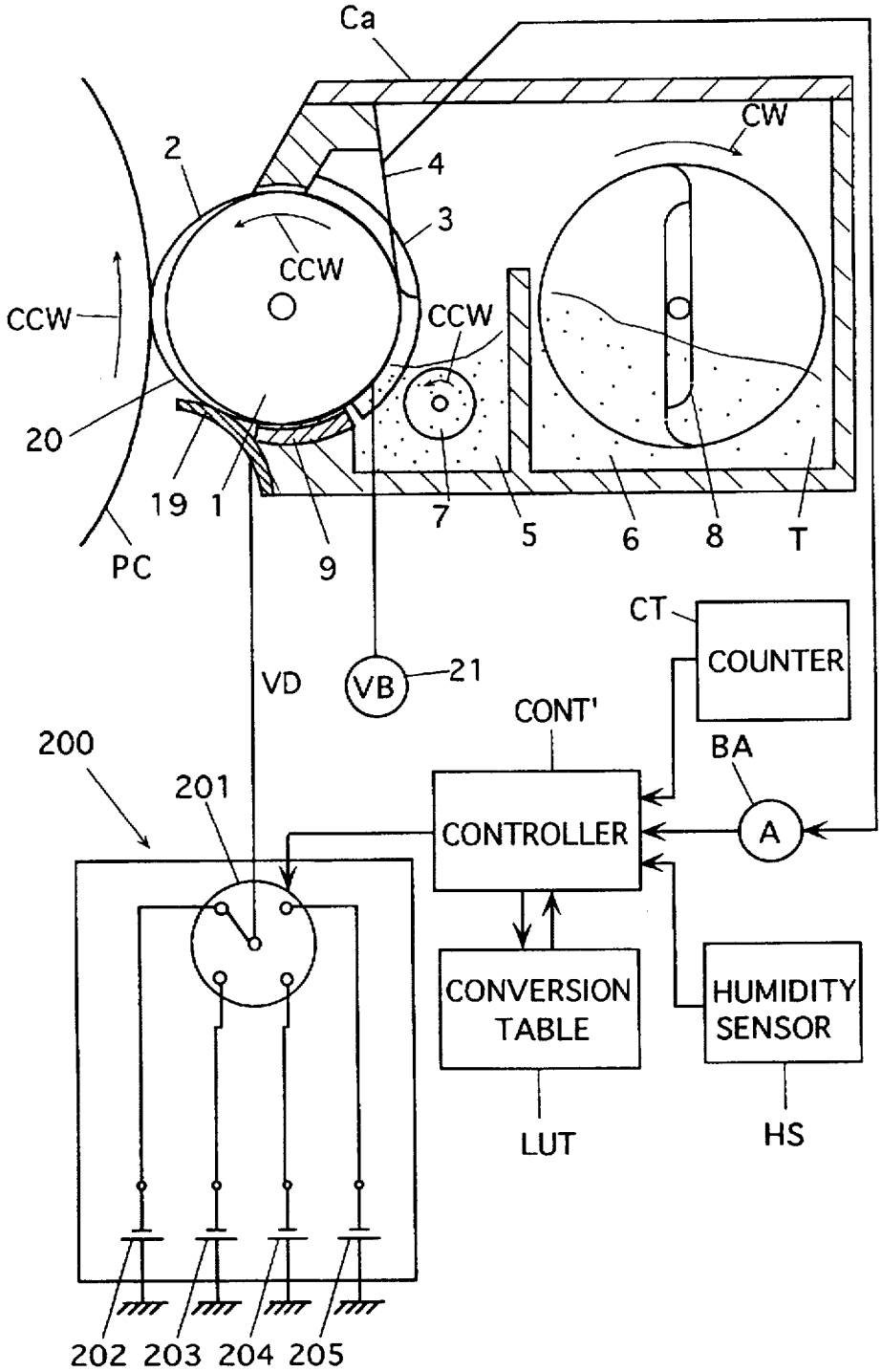
FIG. 4 is a schematic cross section of a one-component developing device of yet another embodiment of the invention.

In the developing device shown in FIG. 4, the toner discharging member 19 is connected to a discharging bias voltage applying unit 200 including a switching portion 201 and discharging bias power supplies 202–205. The switching portion 201 is connected to the controller CONT'. The controller CONT' is connected to components of the means for sensing the charged state of the toner T, and specifically is connected to the counter CT, the ampere meter BA monitoring the value of current flowing through the toner restricting member 4 and the humidity sensor HS. The controller CONT' determines the toner charged state based on input signals from them and a conversion table LUT, which will be described later, and sends a signal for switching the discharging bias voltage VD to the switching portion 201 in accordance with the toner charged state. Thereby, the discharging bias power supplies 202–205 are selected.

In this embodiment, the power supply 202 supplies −200 (V), the power supply 203 supplies −250 (V), the power supply 204 supplies −275 (V) and the power supply 205 supplies −300 (V).

In any one of the foregoing one-component developing devices, the toner T which is fed from the toner supply chamber 6 into the buffer chamber 5 by the rotation member 8 is successively supplied to the surface of the developing sleeve 2 at the developer supply region by the toner supply rotation member 7. Meanwhile, the sleeve 2 is frictionally driven by the rotating drive roller 1, and the toner T supplied to the sleeve 2 is frictionally charged when it moves between the developing sleeve 2 and the toner restricting blade 4 applying the pressure to the toner, so that a thin film of the toner having a predetermined thickness is formed and held on the sleeve surface. The thin film of toner is transported to the developing region confronting the photosensitive drum PC, and is used for developing an electrostatic latent image with the developing bias VB supplied by the power supply 21.

In accordance with the rotation of sleeve 2, the extra toner T after development moves between the sleeve 2 and the toner discharging member 19, which is in contact with the sleeve 2 at the region downstream to the developing region, and returns to the toner supply side while keeping a contact with the member 19.

When the extra toner T moves between the toner discharging member 19 and the developing sleeve 2, the toner T is attracted to the toner discharging member 19 by an electrostatic force caused by a potential difference between the discharging bias voltage VD applied to the toner discharging member 19 and the developing bias voltage VB (here, a constant value of −300 (V)) applied to the developing sleeve 2. The attracted toner T is discharged by the friction with the toner discharging member 19, so that it can be separated easily from the developing sleeve 2 after it passes by the member 19. A relationship of the developing bias voltage VB and the discharging bias voltage VD with respect to the discharging effect is shown in FIG. 5.

Figure 5:
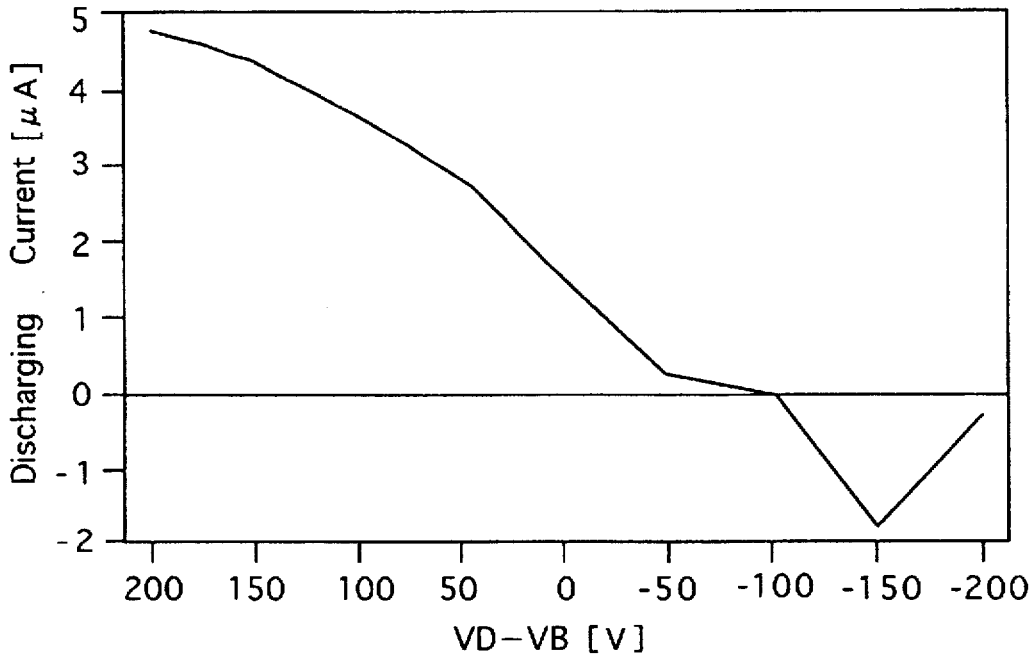
FIG. 5 shows a practical example of a relationship between a potential difference between a discharging bias voltage and a developing bias voltage and a discharging current flowing through a toner discharging member.

FIG. 5 shows a discharging current produced by the potential difference between the developing bias voltage VB and the discharging bias voltage VD, and in other words shows a quantity of charges which are removed from the toner when the toner passes by the discharging member 19. As the value of (VD-VB) increases, the electrostatic force attracting the toner T onto the discharging member 19 increases, so that discharging by the friction between the member 19 and the toner T is performed to a higher extent. As a result, the electrostatic force between the toner and the developing sleeve 2 is weakened, and the toner can be separated more easily from the developing sleeve 2 in the supply chamber 6 after it passed by the member 19. However, as the value of (VD-VB) increases, the toner of the opposite polarity is liable to be generated due to contact and friction with the toner discharging member 19 to a higher extent.

Figure 6:
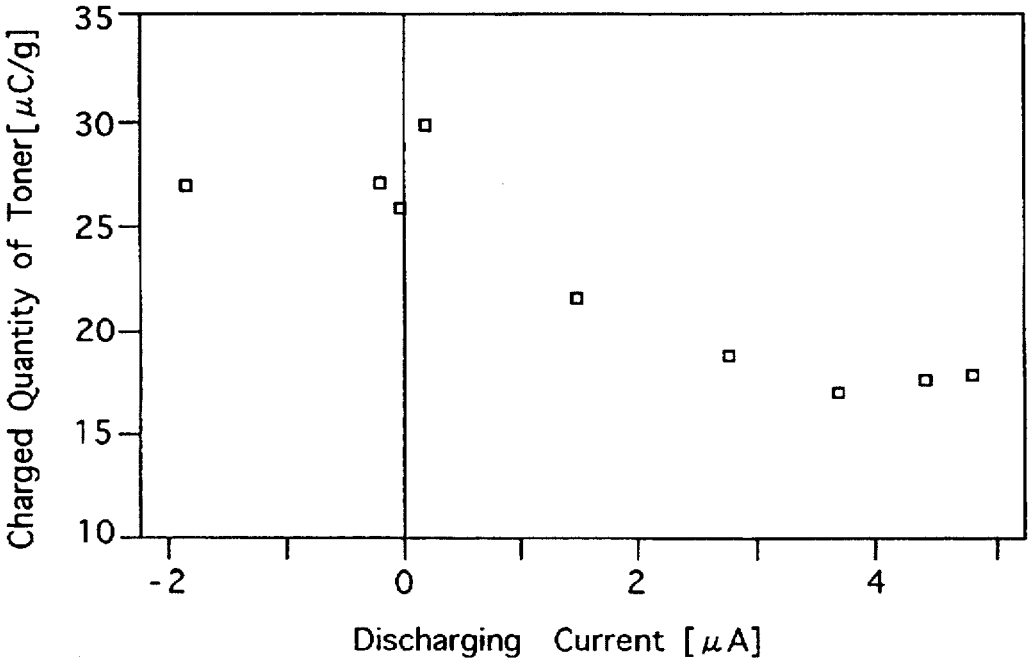
FIG. 6 shows a practical example of a relationship between a discharging current flowing through a toner discharging member and a charged quantity of toner passed by a toner restricting blade.

FIG. 6 is a graph showing a relationship between the discharging current and the toner charged quantity, i.e., quantity of charges of toner passed by the toner restricting blade 4. As the discharging current decreases, the quantity of charges of toner passed by the toner restricting blade 4 increases. The reason for this is as follows. If the discharging current is small, the electrostatic force between the toner and the developing sleeve 2 is not reduced sufficiently, or electrostatic attraction occurs, so that the toner passed by the member 19 is not separated from the developing sleeve 2 in the supply chamber 6, and will frictionally slide between the restricting blade 4 and the developing sleeve 2. Therefore, the toner which is not separated from the sleeve in the supply chamber 6 is charged repetitively at the restricting portion, and thus the quantity of charges gradually increases.

In the developing device shown in FIG. 1, the means for sensing the charged state of the toner and thereby controlling switching of the discharging bias voltage utilizes the counter CT, which is provided at the image forming apparatus equipped with this developing device for counting the cumulative number of printed sheets, and the discharging bias voltage is switched between two values in accordance with the number of printed sheets. In the initial state, the toner has a very good chargeability, so the conditions enabling discharging to a high extent are selected. After a certain number of sheets are printed, the toner has a poor flowability and/or the toner is likely to be stuck to the restricting blade 4. By these and other reasons, the toner cannot be charged easily. However, the surface of the discharging member 19 always has a fresh state, because the member 19 is formed of the elastic member or the like, and its surface is shaved off by the toner T sliding thereon. Therefore, its discharging performance is substantially constant over a term from the initial state to the used state after printing of many sheets. In view of the above, the discharging bias voltage is switched when the count of the printed sheets reaches to a certain value in order to maintain a constant relationship between the discharging and charging after the printing. More specifically, the applied voltage VDa (high-chargeable state) for the high-chargeable toner (initial state) and the applied voltage VDb (low-chargeable state) for the low-chargeable toner after printing of a predetermined number of sheets are set to satisfy a relationship of (VDa (high-chargeable state) >VDb (low-chargeable state)). This inequality is established taking positive and negative into consideration.

By the above manners, good images can be obtained without disadvantages such as filming of toner on the sleeve due to insufficient discharging for a period from the initial state to the printing of a predetermined number of sheets, fogging at a blank portion due to excessive discharging after the printing of the predetermined number of sheets, and sticking of toner to the toner restricting blade 4.

In the developing device in FIG. 2, the means for sensing the charged state of toner and thereby controlling switching of the discharging bias voltage utilizes the ampere meter BA which monitors the value of current flowing through the toner restricting blade 4, and the discharging bias voltage is switched between two values in accordance with the value of current monitored by the ampere meter BA. Thus, at a high temperature and a high humidity, a larger current flows through the toner restricting blade 4, and the toner passed by the restricting blade 4 has a low amount of charges. Therefore, the charged quantity of toner can be sensed by monitoring the value of current flowing through the blade 4. Therefore, the discharging bias voltage corresponding to the monitored current value equal to or larger than a predetermined value is set to be lower than the discharging bias voltage corresponding to the monitored current value smaller than the predetermined value. In this setting, "high" and "low" of the discharging bias voltage is determined taking the positive and negative into consideration.

By the above manners, good images can be obtained without disadvantages such as filming of toner on the sleeve due to insufficient discharging with the monitored current value lower than the predetermined value, fogging at a blank portion due to excessive discharging with the monitored current value of the predetermined value or more, and sticking of the toner to the toner restricting blade 4.

In the developing device shown in FIG. 3, the means for sensing the charged state of toner and thereby controlling switching of the discharging bias voltage utilizes the humidity sensor HS for sensing the humidity in the space accommodating the developing device, and the discharging bias voltage is switched between two values in accordance with the humidity measured by the sensor HS. Thus, at a high temperature and a high humidity, the toner passed by the restricting blade 4 has a lower amount of charges. Therefore, the charged quantity of toner can be sensed by monitoring the humidity. Therefore, the discharging bias voltage corresponding to the humidity equal to or larger than a predetermined value is set to be lower than the discharging bias voltage corresponding to the humidity smaller than the predetermined value. In this setting, "high" and "low" of the discharging bias voltage is determined taking the positive and negative into consideration.

By the above manners, good images can be obtained without disadvantages such as filming of toner on the sleeve due to insufficient discharging with the ambient humidity lower than the predetermined value, fogging at a blank portion due to excessive discharging with the humidity of the predetermined value or more, and sticking of toner to the toner restricting blade 4.

In the developing device shown in FIG. 4, the discharging bias is switched in accordance with combination of the developing devices shown in FIGS. 1 to 3. In this embodiment, according to combinations of a read value C of printed sheets by the counter CT, a read value I of the current flowing through the toner restricting blade 4 by the ampere meter BA, and a read value H of an ambient humidity by the humidity sensor HS, the toner charged state is sensed and classified into two stages including eight states. Based on these states, the discharging bias voltage is set. These are shown in the following table. In the following table, Cp represents the set value of cumulative printed sheet number, Hp represents the humidity set value, and Ip represents the current set value. VD1-VD8 represent set discharging bias voltages in the respective charged states of the toner.

| | H < Hp (% R/H) (High Charge) | H ≧ Hp (% RH) (Low Charge) |
|---|---|---|
| O ≦ C < Cp (High Charge) | | |
| I < Ip (μA) (High Charge) | VD1 (V) | VD3 (V) |
| I ≧ Ip (μA) (Low Charge) | VD2 (V) | VD4 (V) |
| Cp ≦ C (Low Charge) | | |
| I ≧ Ip (μA) (High Charge) | VD5 (V) | VD7 (V) |
| I < Ip (μA) (Low Charge) | VD6 (V) | VD8 (V) |

In the above table, combinations of Cp, Ip, Hp and VD1-VD8 are recorded in the conversion table LUT connected to the controller CONT' shown in FIG. 4.

In each of the developing devices described above, the toner discharging member 19 is independent from the lower seal member 9. However, the toner discharging member may be disposed at the position of the lower seal member 9 so that the toner discharging member 9 may serve also as the lower seal member.

Experimental examples and experimental comparison examples will be described below. In the following examples, there were prepared developing devices shown in FIGS. 1 to 4, respectively. In each of them, the lower seal member 9 was replaced with the toner discharging member, which served also as the lower seal member, and the developing device thus constructed was assembled into the printer. The printers thus constructed were operated, and images were evaluated.

[Experimental Example 1]

In the developing device shown in FIG. 1, the toner discharging member is disposed at the position of the lower seal member, and is used also as the lower seal member.

| | |
|---|---|
| Switching timing of discharging bias voltage: | 2000th printed sheet |
| Discharging bias VDa, VDb: | |
| initial–1999th sheet | VDa = −200 (V) |
| after 1999th sheet | VDb = −300 (V) |
| developing bias voltage VB = −300 (V) (constant) | |
| Toner T: | |
| negatively chargeable toner | |
| thermoplastic polyester-contained resin, 100 wt. parts | |
| carbon black MA #100, 4 wt. parts | |
| hydrophobic silica, 0.8 wt. parts(post treatment agent) | |
| Toner discharging member: | |
| tape made of tetrafluoroethylene resin containing carbon powder dispersed therein (Nitto Denko Co., Ltd., No. 903SC), and serving also as under seal member | |
| Developing sleeve 2: | polyamide |
| Toner restricting member 4: | stainless steel |
| Toner supply rotary member 7: | aluminum |
| Photosensitive drum PC: | negatively chargeable photosensitive drum |

[Experimental Example 2]

In the developing device shown in FIG. 2, the toner discharging member is disposed at the position of the lower seal member, and the toner discharging member is used also as the lower seal member.

Discharging bias VDa and VDb: switched as follows in accordance with the blade current I.

| | |
|---|---|
| I < 1 μA | VDa = −200 (V) |
| I ≧ 1 μA | VDb = −300 (V) |

The direction of the current from the blade to the power supply is deemed as the positive direction.

Developing bias voltage VB =−300 (V) (constant)

Other conditions are the same as those in the experimental Example 1.

[Experimental Example 3]

In the developing device shown in FIG. 3, the toner discharging member is disposed at the position of the lower seal member, and the toner discharging member is used also as the lower seal member.

Discharging bias VDa and VDb: switched as follows in accordance with the relative humidity H.

| | |
|---|---|
| H < 60% RH | VDa = −200 (V) |
| H ≧ 60% RH | VDb = −300 (V) |

Developing bias voltage VB =−300 (V) (constant)

Other conditions are the same as those in the experimental Example 1.

[Experimental Example 4]

In the developing device shown in FIG. 4, the toner discharging member is disposed at the position of the lower seal member, and the toner discharging member is used also as the lower seal member.

Discharging bias VD1-VD8: switched as follows in accordance with the following 8-matrix of data of the counter, ampere meter and humidity sensor.

| | H < 60% RH | H ≧ 60% RH |
|---|---|---|
| | Counter Value: 0–1999 | |
| I < 1 μA | (1) VD1 = −200 (V) | (3) DV3 = −275 (V) |
| I ≧ 1 μA | (2) VD2 = −250 (V) | (4) VD4 = −300 (V) |
| | Counter Value: 2000 or more | |
| I < 1 μA | (5) VD5 = −250 (V) | (7) DV7 = −300 (V) |
| I ≧ 1 μA | (6) VD6 = −300 (V) | (8) VD8 = −300 (V) |

Developing bias voltage VB=−300 (V) (constant)

Other conditions are the same as those in the experimental Example 1.

[Comparative Experimental Example 1]

Setting of discharging bias voltage VD=−200 (V) (fixed)

Other conditions are the same as those in the experimental Example 1.

[Comparative Experimental Example 2]

Setting of discharging bias voltage VD=−300 (V) (fixed)

Other conditions are the same as those in the experimental Example 1.

| | fogging | sticking | filming |
|---|---|---|---|
| Ex. 1* | ○ | ○ | ○ |
| Ex. 2 | ○ | ○ | ○ |
| Ex. 3 | ○ | ○ | ○ |
| Ex. 4 | ○ | ○ | ○ |
| C/E. 1* | X | X | ○ |
| C/E. 2 | ○ | ○ | X |

Ex.*: Experimental Example
C/E.*: Comparative Example

Result of Image Evaluation

In the above table, the marks "O" in the column of "fogging" (i.e., fogging at the blank) represent a good state without toner development at a non-image portion. The marks "O" in the column of "sticking" (i.e., sticking of toner to the restricting member) represent a state where sticking of toner to the toner restricting blade 4 is not found. The marks "O" in the column of "filming" (i.e., sleeve filming) represent a good state where toner filming on the developing sleeve 2 does not occur. The marks "X" represent an insufficient state.

From the above results, it is understood that the one-component developing devices according to the invention can overcome problems such as fogging, toner adhesion and filming by changing the discharging bias voltage applied to the toner discharging member in accordance with the charged state of toner which varies in accordance with the environment and the number of printed sheets.

The developing device of the embodiment and the experimental examples described above perform reversal development with negatively chargeable toner. If regular development is to be performed with positively chargeable toner instead of negatively chargeable toner, the discharging bias voltage is set to establish a relationship of VDx<VDy, where VDx represents the discharging bias voltage for the toner charged to a certain potential, and DVy represents the discharging bias voltage for the toner charged to a potential lower than the above. Also, positive change of the voltage is deemed as increase, and negative change is deemed as decrease.

DEVELOPING DEVICE OF THE SECOND TYPE

The developing device of the second type described before will be described below more in detail.

Means for determining the switching timing of the discharging bias voltage and instructing the switching may be operated in a measuring mode, which is set independently of the mode for operating the one-component developing device of the invention to perform a primary operation, i.e., development of electrostatic latent images. This measuring mode is set, for example, before the image forming mode in which the one-component developing device of the invention employed in an image forming apparatus is operated for its primary operation, i.e., development of electrostatic latent images.

The means for determining the switching timing of the discharging bias voltage and instructing the switching may be one of the following structures.

(1) The structure which includes sensing means for sensing the state of adhesion of toner onto the electrostatic latent image carrier, and operates to determine the timing of switching of the discharging bias voltage based on the information of the state of toner adhesion sent from the sensing means and send an instruction of switching of the discharging bias voltage to the discharging bias voltage switching means.

In this case, the sensing means may be a photosensor opposed to a portion on the electrostatic latent image carrier at which toner adhesion is to be sensed. The photosensor senses, for example, light reflected by the portion on the electrostatic latent image carrier at which the toner adhesion is to be sensed, whereby the quantity or degree of adhering toner can be sensed. If the toner is negatively chargeable, and the quantity of adhering toner is to be sensed, the discharging bias potential VD is set as follows with respect to the developing bias potential VB. When the quantity of adhering toner is large, (VD-VB) is set to be larger than that of a standard setting. If small, it is set to be smaller than that of a standard setting. When the toner is positively chargeable and fogging toner is to be sensed, the relationship of (VD-VB) is set oppositely.

The portion at which toner adhesion is to be sensed may be the developing portion, e.g., of the reference pattern formed on the electrostatic latent image carrier prior to the sensing, and alternatively may be a portion of a non-image portion at which fogging toner may adhere.

(2) The structure which includes current sensing means for sensing a current flowing through the toner discharging member. A timing of switching of the discharging bias voltage is determined based on the current sensed by the current sensing means, so that an instruction of switching of the discharging bias voltage is sent to the discharging bias voltage switching means.

This current (discharging current) is based on the potential difference between the developing bias and the discharging bias, and corresponds to the quantity of charges which are removed when the toner passes by the toner discharging member.

In this case, such structures may be employed that (a) includes a constant current circuit connected to the toner discharging member and sends an instruction to switch the discharging bias voltage in an analog manner so as to maintain the constant discharging current, or that (b) includes an operation table for obtaining an appropriate switchable discharging bias voltage for the sensed current (discharging current). In this structure (b),the switching timing for the discharging bias voltage as well as the discharging bias voltage after the switching are determined from the sensed current and the operation table, and thereby an instruction of switching of the discharging bias voltage is sent to the discharging bias voltage switching means.

The constant current circuit in the structure, which is provided for instructing switching of the discharging bias voltage so as to maintain the constant discharging current, may include a variable power supply, a power supply output operating portion which can change in an analog manner the power supply output, and a circuit which senses a current flowing through the toner discharging member, and sends an instruction to the operating portion to switch in an analog manner the discharging bias voltage applied to the toner discharging member based on the sensed current for maintaining this current at a constant value.

Embodiments of the developing device of the second type according to the invention will be described below with reference to FIGS. 7 to 13.

The developing devices which will be described later are one-component developing devices which perform reversal development with negatively chargeable toner.

Any of the developing devices is assembled in an electrophotographic image forming apparatus, and is opposed to an electrostatic latent image carrier (here, photosensitive drum) PC. The photosensitive drum PC is driven to rotate in a direction indicated by an arrow CCW in the figure, and its surface is uniformly charged by a charging device (not shown). Image exposing means (not shown) performs image exposure on the charged region to form an electrostatic latent image corresponding to an original image. The developing device develops this electrostatic latent image to form a toner image. This toner image is transferred onto transfer member by tranferring means (not shown), and subsequently is fixed by a fixing device (not shown).

Figure 7:
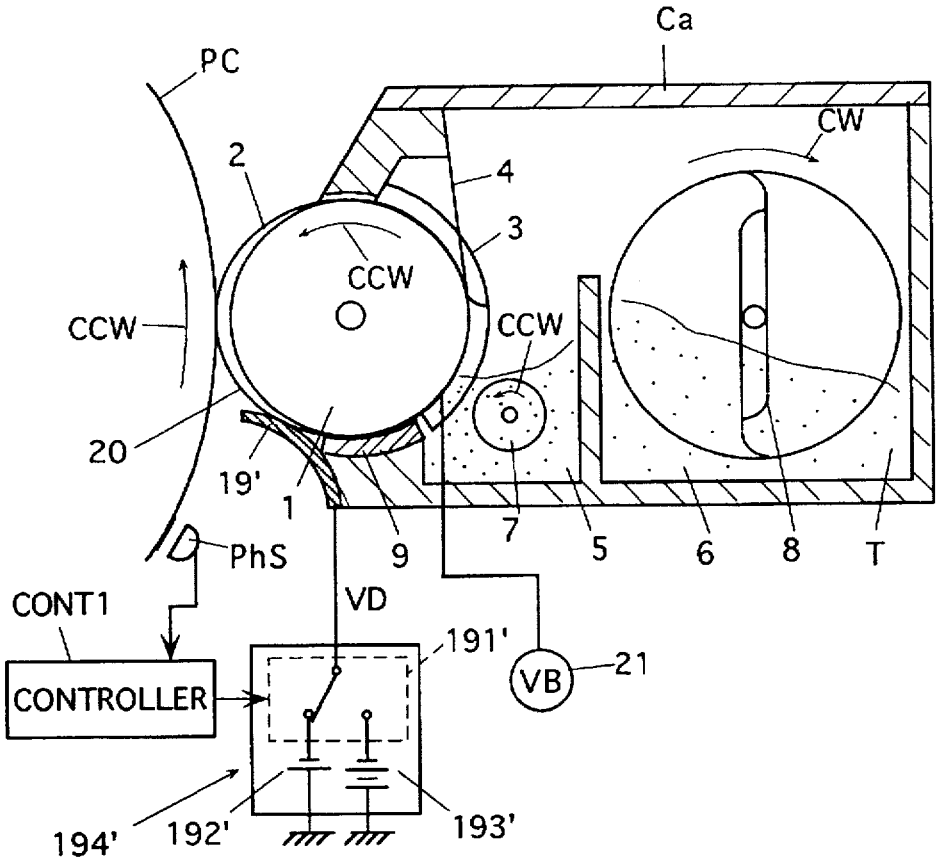
FIG. 7 is a schematic cross section of a one-component developing device of further another embodiment of the invention.

The developing device shown in FIG. 7 differs from that in FIG. 1 in that a discharging bias voltage applying unit 194 is replaced with a discharging bias voltage applying unit 194'.

The discharging bias voltage applying unit 194' includes two kinds of power supplies 192' and 193' for high and low voltages which are employed for applying the discharging bias voltage VD to a toner discharging member 19', and a switching portion 191' for selectively connecting power supplies 192' and 193' to the toner discharging member 19'.

The switching portion 191' can perform switching of the discharging bias voltage in response to an instruction from a discharging bias controller CONT1. The controller CONT1 determines the discharging bias voltage switching timing in accordance with an output of a photosensor PhS opposed to the photosensitive member PC, and instructs the switching portion 191' to switch the discharging bias voltage.

Structures other than the above are the substantially same as those of the developing device shown in FIG. 1, and corresponding portions bear the same reference numbers as those in FIG. 1.

In the device shown in FIG. 7, 1 indicates the drive roller, 2 indicates the developing sleeve inserted into the roller 2, 3 indicates a pressing guide for pressing the sleeve against the drive roller 1, 4 indicates the toner restricting blade in contact with the developing sleeve 2, 5 indicates a buffer chamber, 6 indicates a toner supply chamber, 7 indicates a toner supply rotary member in the buffer chamber 5, 8 indicates a toner stirring/supply rotary member in the toner supply chamber 6, and T indicates toner. The drive roller 1 and the toner supply rotary member 7 are driven to rotate in the direction CCW in the figure. The toner stirring/supply rotary member 8 is driven to rotate in the CW direction in the figure. The developing sleeve 2 pressed by the pressing guides 3 has the loose portion 20 formed at the side opposite to the pressing guides 3. In this example, the loose portion 20 is in soft contact with the surface of the photosensitive drum PC.

The toner discharging member 19' contains a material having a good electrical conductivity and dispersed therein for suppressing accumulation of the charges and smoothly discharging the toner.

The photosensor PhS and the discharge bias controller CONTI will be described below more in detail.

Figure 8:
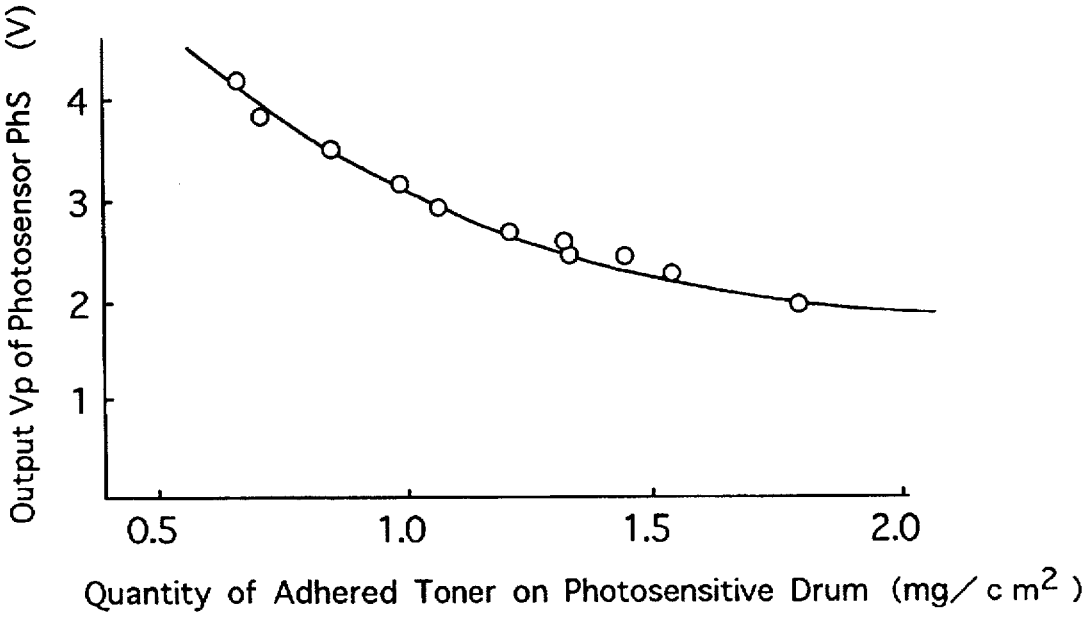
FIG. 8 shows a relationship between a quantity of adhered toner in the reference pattern on a photosensitive member and an output of a photosensor sensing the quantity of the adhered toner.

The photosensor PhS senses light reflected from the reference pattern (developed pattern), which has been formed on the photosensitive member PC, and thereby senses the quantity of adhering toner. As can be seen from FIG. 8 showing a practical example of the relationship between the quantity of adhering toner and the photosensor output, the photosensor output Vp is large when the adhering toner quantity is mall, and is small when the adhering toner quantity is large.

The discharging bias controller CONT1 sends the instruction for switching and setting the discharging bias voltage as follows. The discharging bias voltage is set to attain conditions facilitating development, when the photosensor output Vp is equal to or larger than a predetermined threshold voltage Vth, and in other words, when the adhering toner quantity is small. When the photosensor output Vp is smaller than the threshold voltage Vth, and in other words, when the adhering toner quantity is large, the discharging bias voltage is set to facilitate separation of the toner from the portion on the photosensitive member PC returning into the developing device casing Ca. In this example, the discharging bias voltage is switched between two stages. However, it may be switched among three or more stages.

By the switching of the discharging bias voltage, the quantity of adhering toner on the photosensitive member PC can be stabilized. Further, the toner can be stably and easily separated from the portion on the photosensitive member returning to the casing Ca. Thereby, disadvantages such as filming of the toner on the developing sleeve 2 can be suppressed.

Figure 9:
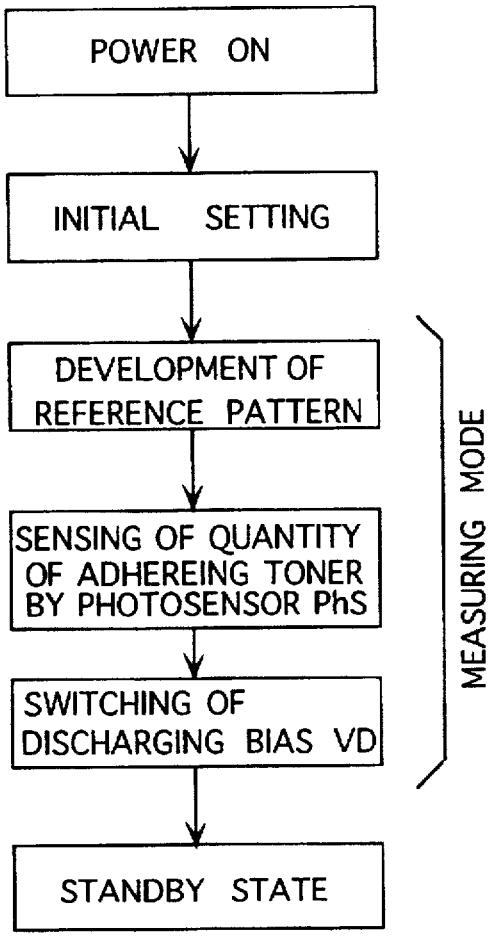
FIG. 9 shows an example of procedure for switching a discharging bias voltage in the developing device in FIG. 7.

Switching of the discharging bias voltage VD is performed under the instruction of, for example, the controller, which controls the operation of the image forming apparatus with the developing device of the invention, and is performed in the measuring mode before the image forming mode in which the developing device performs its major operation, i.e., development of an electrostatic latent image. FIG. 9 shows the procedures. The "standby state" in FIG. 9 represents the state before input of the instruction for starting the image formation.

Figure 10:
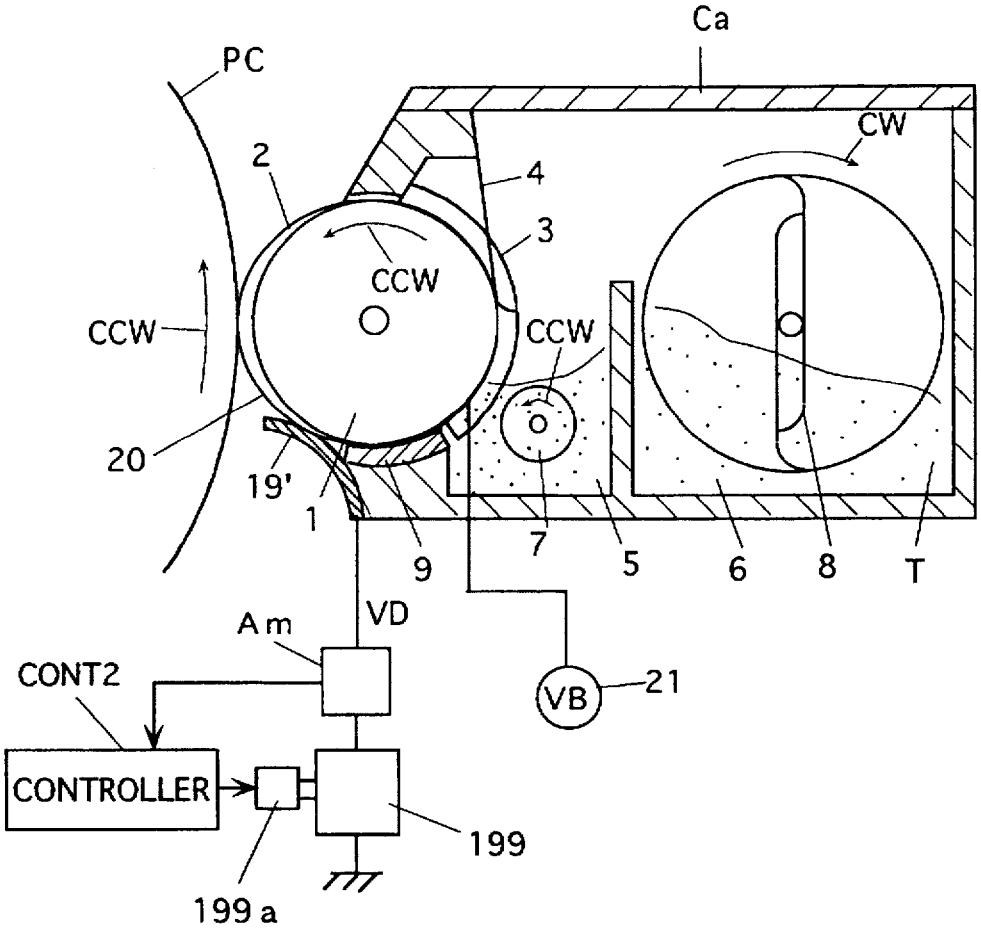
FIG. 10 is a schematic cross section of a one-component developing device of a further embodiment of the invention.

The developing device shown in FIG. 10 differs from the developing device in FIG. 7 in that the voltage applying unit 194', photosensor PhS and controller CONT1 are replaced with a variable voltage power supply 199 for applying the discharging bias voltage to the toner discharging member 19', a power supply output operating portion 199*a* capable of changing the power supply output in an analog manner, an ampere meter Am sensing the current flowing through the toner discharging member 19',and a discharging bias controller CONT2 which determines the discharging bias voltage switching timing in accordance with the current sensed by the ampere meter Am and instructs the operating portion 199*a* to switch the discharging bias voltage. Structures other than the above are the same as those of the developing device shown in FIG. 7. Similar portions bear the same reference numbers.

Figure 11:
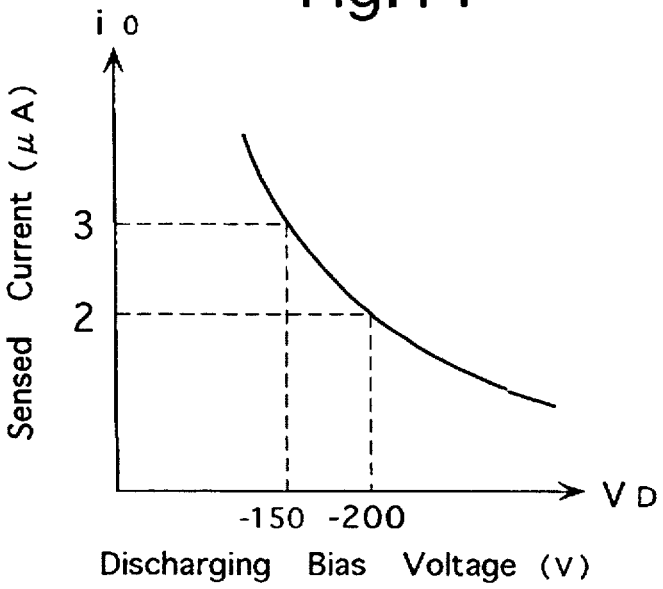
FIG. 11 shows an example of contents of an operation table for obtaining a discharging bias voltage to be switched in accordance with a current flowing through a toner discharging member.

The discharging bias controller CONT2 will be described below more in detail. The controller CONT2 uses, as a current to be sensed, a current io which is sensed when a non-image portion or an inter-image corresponding portion on the developing sleeve 2 uniformly bearing the toner moves in contact with the toner discharging member 19. The controller CONT2 includes an operation table for obtaining an appropriate discharging bias voltage to be set for the current io. From the sensed current io and the operation table, the controller CONT2 determines the switching timing for the discharging bias voltage together with the discharging bias voltage after the switching, and instructs the operating portion 199*a* to switch the discharging bias voltage. FIG. 11 shows an example of contents of the operation table. According to this table, the discharging bias voltage VD is set to −150 (V) when the sensed current io is, for example, 3μA, and the discharging bias voltage VD is set to −200 (V) when the sesnsed current io is 2μA.

Figure 12:
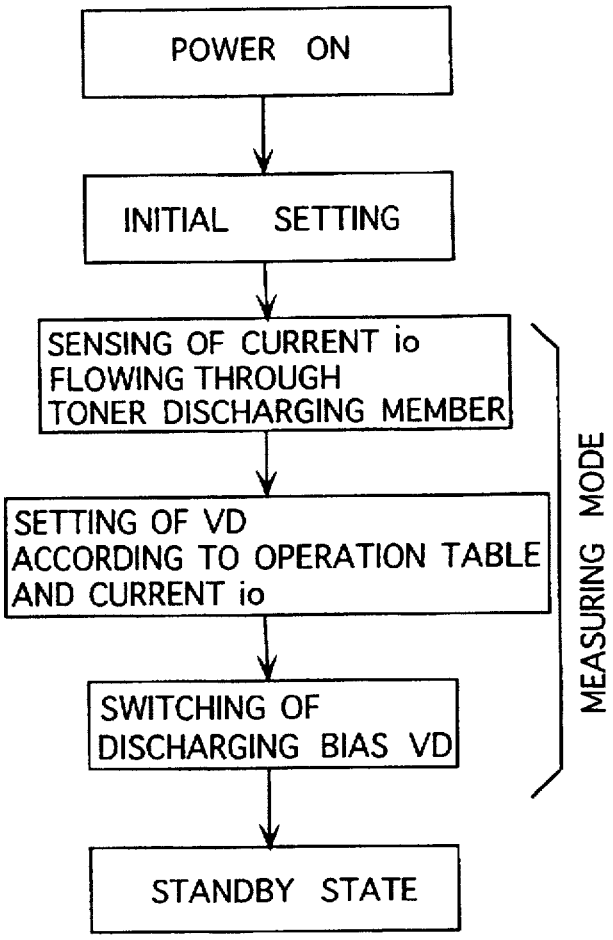
FIG. 12 shows an example of procedure for switching a discharging bias voltage in the developing device shown in FIG. 10.

Switching of the discharging bias voltage VD is performed, for example, under the instruction of the controller which controls the operation of the image forming apparatus with the developing device of the invention, and is specifically performed in the measuring mode before the image forming mode in which the developing device performs its major operation, i.e., development of an electrostatic latent image. FIG. 12 shows the procedures. In FIG. 12, the "standby state" is a state before input of an instruction of start of image formation.

According to this developing device, excessive discharging can be prevented by switching the discharging bias voltage VD, when the toner discharging member 19' is in contact with the developing sleeve 2 through a large nip width and the current io is large. Conversely, when the current io is small and insufficient discharging may occur, the toner discharging can be performed sufficiently by switching the discharging bias voltage VD.

In this developing device, the quantity of the toner adhering onto the photosensitive member PC may be stable owing to the switching of the discharging bias voltage corresponding to the sensed current io. Therefore, the toner can be stably and easily separated from the portion on the photosensitive member returning into the casing Ca. Thereby, disadvantages such as filming of the toner on the developing sleeve 2 can be suppressed.

Figure 13:
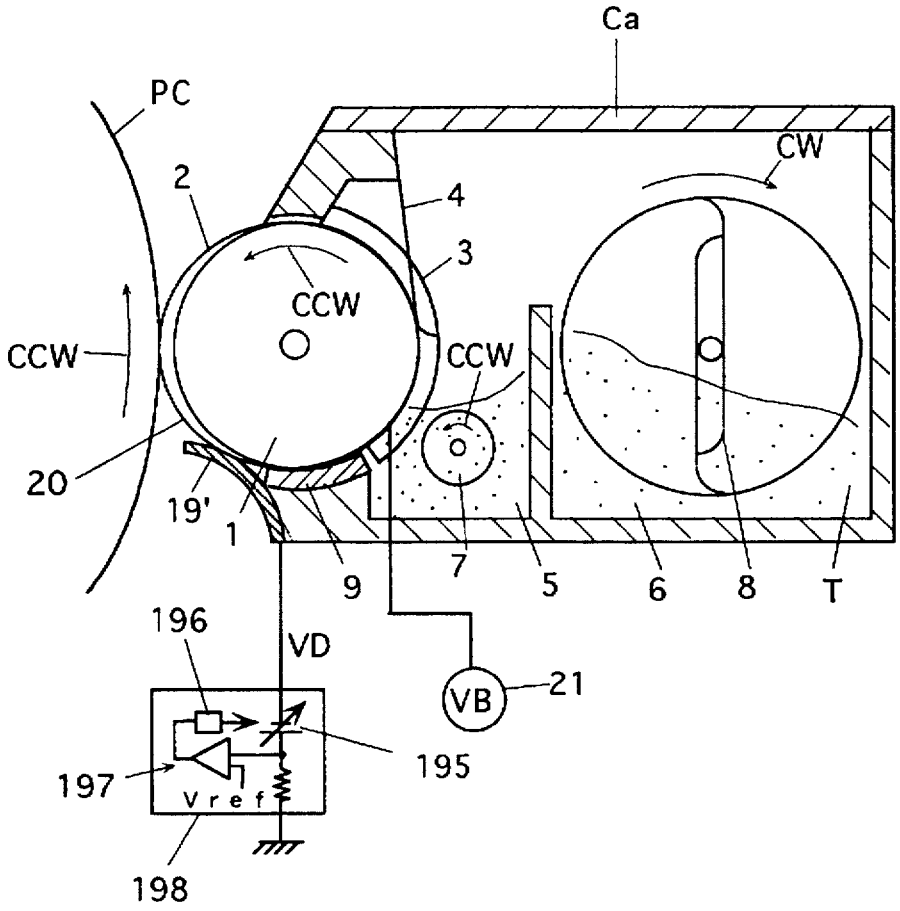
FIG. 13 is a schematic cross section of a one-component developing device of a further embodiment of the invention.

The developing device shown in FIG. 13 includes a constant current circuit 198 instead of the voltage applying unit 194', photosensor PhS and controller CONT1 in the device in Fig.7. The constant current circuit 198 includes a voltage variable power supply 195, a power supply output operating portion 196 which can change the output from the power supply 195 in an analog manner, and a circuit 197 which senses the current flowing through the toner discharging member 19' and switches in an analog manner the discharging bias voltage VD applied to the toner discharging member 19' based on the sensed current so as to maintain the current at a constant value. Structures other than the above are the same as those of the developing device shown in FIG. 7, and similar portions bear the same reference numbers.

Switching of the discharging bias voltage in this developing device is based on the following.

As can be seen from FIG. 5 which exemplifies change in the discharging current with respect to the potential difference between the developing bias and the discharging bias, the discharging current increases as the potential difference (VD-VB) between the developing bias VB and the discharging bias VD increases. This promotes separation of the toner from the developing sleeve 2. However, increase in the potential difference (VD-VB) increases a contact friction between the toner and the toner discharging member 19',so that oppositely chargeable toner is liable to be generated. Also, as can be seen from FIG. 6 exemplifying the change in toner charged quantity with respect to the change in the discharging current, the toner charged quantity changes correspondingly to the change in the discharging current. Therefore, an intended operation can be performed by controlling the discharging bias so that the discharging current is always set to the discharging current value which is set, in advance, from a necessary charged quantity.

In this developing device, the quantity of the toner adhering onto the photosensitive member PC is stable. Also, the toner can be stably and easily separated from the portion on the photosensitive member returning into the casing Ca. Thereby, disadvantages such as filming of the toner on the developing sleeve 2 can be suppressed.

In any one of the developing devices shown in FIGS. 7, 10 and 13, the toner T is supplied to the developer supply region in the developing device casing Ca and particularly onto the surface of the developing sleeve 2 which is driven to rotate, similarly to the conventional developing device. When the toner T moves between the toner restricting blade 4 and the developing sleeve 2, it is supplied with charges owing to frictional charging under the pressure of the toner restricting blade 4. The toner T thus moved forms a thin film of a predetermined thickness, is held on the surface of the developing sleeve 2, and is transported to the developing region opposed to the photosensitive member PC, in which the electrostatic latent image is developed with the toner T by applying the developing bias voltage VB.

In the developing device of the second type described above, however, the extra toner after the development moves, in accordance with rotation of the developing sleeve 2, between the developing sleeve 2 and the toner discharging member 19' which is in contact with the developing sleeve 2 at a region downstream to the developing region, and returns to the toner supply side while keeping a contact with the member 19'.

When the extra toner moves between the toner discharging member 19' and the developing sleeve 2, an electrostatic attraction force between the extra toner and the sleeve 2 is weaken by the potential difference between the appropriate discharging bias voltage VD, which is switched and applied to the toner discharging member 19' in accordance with the situation as described above, and the developing bias voltage VB, which is applied to the developing sleeve 2. Also, the extra toner is appropriately discharged by the friction with the toner discharging member 19'. Therefore, the toner passed by the member 19' can be easily separated from the developing sleeve 2 at the toner supply side.

In this manner, it is possible to prevent practical problems, i.e., insufficient discharging of the extra toner after the development and charging to the opposite polarity due to the excessive discharging. In contrast to the case where the discharging bias voltage is always constant, disadvantages such as image fogging, sticking of toner onto the toner restricting member and filming of the toner on the developer carrying member are overcome, and the thin toner layer can be formed stably on the sleeve, so that images of a good quality can be formed.

Description will be given on an experimental Example 1A using the developing device shown in FIG. 7, and comparative experimental Examples 1*a* and 1*b* as well as experimental Examples 2A and 3A using the device shown in FIG. 13 and comparative experimental Examples 2*a* and 3*a*. In the comparative experimental examples, the developing devices differ from that in FIG. 7 in that the voltage applying unit 194' is replaced with a conventional constant voltage power supply, and the photosensor PhS and the controller CONT1 are removed. In each of the devices in these examples, the lower seal member 9 is used also as the toner discharging member 19.

[Experimental Example 1A]

Setting Means for Discharging Bias

| | |
|---|---|
| Sensing means: photosensor PhS (output voltage Vp) | |
| Switching timing: threshold voltage Vth = 3.8 (V) | |
| Discharging bias | VD = −200 (V) (Vp ≧ Vth) |
| | VD = −300 (V) (Vp < Vth) |
| developing bias voltage VB = −300 (V) (fixed) | |
| Toner T: negatively chargeable toner | |
| thermoplastic polyester-contained resin 100 wt. parts | |
| carbon black MA #100, 4 wt. parts | |
| hydrophobic silica, 0.8 wt. parts (post treatment agent) | |
| Toner Discharging Member: | |
| electrically conductive tape containing carbon powder dispersed therein, and serving also as under seal member 9 | |
| contact width with developing sleeve 2 (nip width): 6 mm | |
| Developing sleeve 2: | polyamide |
| Toner restricting blade 4: | stainless steel |
| Toner supply rotary member 7: | aluminum |
| Photosensitive drum PC: | negatively chargeable photosensitive drum |

[Comparative Experimental Example 1a]

Setting of Discharging Bias VD=−200 (V) (fixed)

Other conditions are the same as those of the experimental Example 1

[Comparative Experimental Example 1b]

Setting of Discharging Bias VD=−300 (V) (fixed) Other conditions are the same as those of the experimental Example 1

[Experimental Example 2A]

Setting Means for Discharging Bias

Analog control by constant current circuit

Discharging current: 2 (μA) (constant)

Contact width between toner discharging member and developing sleeve 2 (nip width): 7 mm (upper tolerance limit)

Other conditions are the same as those of the experimental Example 1.

[Experimental Example 3A]

Setting Means for Discharging Bias

Analog control by constant current circuit

Discharging current: 2 (μA) (constant)

Contact width between toner discharging member and developing sleeve 2 (nip width): 5 mm (lower tolerance limit)

Other conditions are the same as those of the experimental Example 1.

[Comparative Experimental Example 2a]

Setting of Discharging Bias VD=−250 (V) (fixed)

Contact width between toner discharging member and developing sleeve 2 (nip width): 5 mm (upper tolerance limit)

Other conditions are the same as those of the experimental Example 1.

[Comparative Experimental Example 3a]

Setting of Discharging Bias VD=−250 (V) (fixed)

Contact width between toner discharging member and developing sleeve 2 (nip width): 5 mm (lower tolerance limit)

Other conditions are the same as those of the experimental Example 1.

Results of image evaluation by the above examples are as follows.

| | fogging | sticking | filming |
|---|---|---|---|
| Ex. 1A* | ○ | ○ | ○ |
| C/E 1a* | X | X | ○ |
| C/E. 1b | ○ | ○ | X |
| Ex. 2A | ○ | ○ | ○ |
| Ex. 3A | ○ | ○ | ○ |
| C/E. 2a | X | X | ○ |
| C/E. 3a | ○ | ○ | X |

Ex.*: Experimental Example
C/E.*: Comparative Experimental Example

In the above table, the marks "O" in the column of "fogging" (i.e., fogging at the blank) represent a good state without toner development at a non-image portion. The marks "O" in the column of "sticking" (i.e., sticking of toner to the restricting member) represent a state where sticking of toner to the toner restricting blade 4 is not found. The marks "O" in the column of "filming" (i.e., sleeve filming) represent a good state where toner filming on the developing sleeve 2 does not occur. The marks "X" represent an insufficient state.

From the above results, it is understood that the one component developing devices of the second type according to the invention can provide good images without fogging at the blank, toner adhesion to the toner restricting blade, and toner filming on the developing sleeve.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A one-component developing device comprising:

a developer carrying member arranged in a developing region for developing an electrostatic latent image formed on an electrostatic latent image carrier, opposed to said electrostatic latent image carrier, and being driven to move its own surface;

a toner restricting member being in contact with the surface of said developer carrying member, and being operable to hold charged toner in a form of a thin film on the surface of said developer carrying member by moving the toner supplied to said developer carrying member between the moving surface of said carrying member and said toner restricting member;

means for applying a developing bias voltage to said developer carrying member;

a toner discharging member being in contact with the surface of said developer carrying member at a position downstream to said developing region in a moving direction of said developer carrying member surface;

sensing means for sensing a charged state of the toner; and means for applying a discharging bias voltage to said toner discharging member in accordance with the result of detection by said sensing means, said developer carrying member being operable to hold and return residual toner not consumed by said development to a toner supply region for said developer carrying member.

2. A one-component developing device according to claim 1, wherein said discharging bias voltage applying means is operable to switch, between multiple stages, a voltage applied to said toner discharging member in accordance with the result of sensing by said sensing means.

3. A one-component developing device according to claim 1, wherein said sensing means for sensing the charged state of the toner includes a counter for counting the number of printed sheets, and is operable to sense the charged state of the toner based on the number of the sheets counted by said counter.

4. A one-component developing device according to claim 3, wherein said toner charged state sensing means senses the toner charged state based on whether or not the counter counts one or more cumulative sheet set numbers which are deemed as a boundary between different toner charged states.

5. A one-component developing device according to claim 1, wherein said sensing means for sensing the charged state of the toner includes an ampere meter monitoring a current flowing through said toner restricting member, and senses the charged state of the toner based on the current value monitored by said ampere meter.

6. A one-component developing device according to claim 5, wherein said toner charged state sensing means senses the toner charged state based on whether or not the ampere meter senses one or more current set values which are deemed as a boundary between different toner charged states.

7. A one-component developing device according to claim 1, wherein said sensing means for sensing the charged state of the toner includes a humidity sensor measuring a humidity, and senses the charged state of the toner based on the value of humidity measured by said sensor.

8. A one-component developing device according to claim 7, wherein said toner charged state sensing means senses the toner charged state based on whether or not said humidity sensor measures one or more humidity set values which are deemed as a boundary between different toner charged states.

9. A one-component developing device according to claim 1, wherein said sensing means for sensing the charged state of the toner includes:

a counter for counting the number of printed sheets, an ampere meter monitoring a current flowing through said toner restricting member, a sensor measuring a humidity, and a conversion table in which predetemined combinations of the number of printed sheets, the value of current flowing through said toner restricting member and the humidity are written, the combinations representing the toner charged states corresponding to the combinations;

the toner charged state is sensed based on the conversion table and the combination of the number of printed sheets counted by said counter, the current value monitored by said ampere meter and the humidity value measured by said humidity sensor; and said means for applying the discharging bias voltage to said toner discharging member has such a structure that it applies a discharging bias voltage to said toner discharging member based on the toner charged state sensed by said toner charged state sensing means and predetermined discharging bias voltages written in the conversion table and corresponding to the predetermined combinations.

10. A one-component developing device according to claim 9, wherein said table contains a first set value which is one cumulative set value of printed sheets forming a boundary between different toner charged states, a second set value which is one current set value forming a boundary between different toner charged states, and a third set value which is one humidity set value forming a boundary between different toner charged states, and further contains combination of two stages including eight states which are formed in such manner that each of a range lower than the first set value and a range not lower than the first set value are combined with the second and third set values, states lower than and not lower than the set value are determined for each of the second and third set values in each combination, and these states are combined together to form said combinations of two stages including eight states.

11. A one-component developing device comprising:

a developer carrying member arranged in a developing region for developing an electrostatic latent image formed on an electrostatic latent image carrier, opposed to said electrostatic latent image carrier, and being driven to move its own surface;

a toner restricting member being in contact with the surface of said developer carrying member, and being operable to hold charged toner in a form of a thin film on the surface of said developer carrying member by moving the toner supplied to said developer carrying member between the moving surface of said carrying member and said toner restricting member;

a toner discharging member being in contact with the surface of said developer carrying member at a position downstream to said developing region in a moving direction of said developer carrying member surface;

means for applying a discharging bias voltage to said toner discharging member;

means for switching said discharging bias voltage; and means for determining a timing of switching of said discharging bias voltage and sending an instruction of switching of the discharging bias voltage to said discharging bias voltage switching means, said developer carrying member being operable to hold and return residual toner not consumed by the development to a toner supply region for the developer carrying member.

12. A one-component developing device according to claim 11, wherein said discharging bias voltage switching means is operable to switch, between multiple stages, a voltage applied to said toner discharging member.

13. A one-component developing device according to claim 11, wherein said means for determining the switching timing of said discharging bias voltage and instructing the switching includes sensing means for sensing the state of adhesion of toner onto the electrostatic latent image carrier, and operates to determine the timing of switching of the discharging bias voltage based on the information of the state of toner adhesion sent from said sensing means and send an instruction of switching of the discharging bias voltage to said discharging bias voltage switching means.

14. A one-component developing device according to claim 13, wherein said sensing means for sensing the toner adhesion state is a photosensor confronting a toner adhesion portion on the electrostatic latent image carrier to be sensed.

15. A one-component developing device according to claim 14, wherein said toner adhesion portion to be sensed is a developing portion of a reference pattern formed on the electrostatic latent image carrier.

16. A one-component developing device according to claim 14, wherein said toner adhesion portion to be sensed is a non-image portion on the electrostatic latent image carrier bearing fogging toner.

17. A one-component developing device according to claim 11, wherein said means for determining the switching timing of said discharging bias voltage and instructing the switching includes sensing means for sensing a current flowing through said toner discharging member, and operates to determine the timing of switching of the discharging bias voltage based on the current sensed by said current sensing means and send an instruction of switching of the discharging bias voltage to said discharging bias voltage switching means.

18. A one-component developing device according to claim 17, wherein said means for determining the switching timing of said discharging bias voltage and instructing the switching includes a constant current circuit connected to the toner discharging member, and sends an instruction to switch the discharging bias voltage in an analog manner so as to maintain the constant discharging current.

19. A one-component developing device according to claim 17, wherein said means for determining the switching timing of said discharging bias voltage and instructing the switching includes an operation table for obtaining an appropriate switchable discharging bias voltage for the sensed current (discharging current), the switching timing for the discharging bias voltage as well as the discharging bias voltage after the switching are determined from the sensed current and said operation table, and thereby an instruction of switching of the discharging bias voltage is sent to said discharging bias voltage switching means.

20. A one-component developing device according to claim 11, wherein said means for determining the switching timing of said discharging bias voltage and instructing the switching operates during a measuring mode.

21. A developing device comprising:

means for holding toner to develop an electrostatic latent image;

means for charging the toner held by said toner holding means;

means for applying a bias voltage to the toner held by said toner holding means;

means for judging a charged state of the toner; and means for changing the bias voltage in accordance with the result of judgement by said judging means.

22. A developing device according to claim 21, wherein said judging means includes an ampere meter monitoring a current flowing through said charging means, and judges the charged state of the toner based on the current value monitored by said ampere meter.

23. A developing device according to claim 21, wherein said judging means includes a humidity sensor measuring humidity, and judges the charged state of the toner based on the value of humidity measured by said sensor.

24. A developing device, according to claim 21, wherein said judging means includes a conversion table in which predetermined values representing toner charged states, and the toner charged state is judged based on the conversion table and a value representing the charged state of the toner detected by the judging means.

25. A developing device according to claim 21, wherein said judging means includes:

a counter for counting the number of printed sheets, an ampere meter monitoring a current flowing through said charging means, a sensor measuring a humidity, and a conversion table in which predetemined combinations of the number of printed sheets, the value of current flowing through said charging means and the humidity are written, the combinations representing the toner charged states corresponding to the combinations; and the toner charged state is judged based on the conversion table and the combination of the number of printed sheets counted by said counter, the current value monitored by said ampere meter and the humidity value measured by said humidity sensor.

26. A developing device according to claim 21, wherein said judging means judges the charged state of the toner held by said toner holding means according to a developed toner image.

27. A developing device according to claim 21, wherein said judging means judges the charged state of the toner held by said toner holding means according to the held toner.

28. An image forming apparatus for forming a toner image comprising:

means for accommodating toner therein;

means for holding an electrostatic latent image thereon;

means for charging the toner accommodated in said toner accommodating means;

means for developing the electrostatic latent image on said electrostatic latent image holding means by the toner charged by said toner charging means;

means for detecting a charged state of the toner; and means for applying a discharging bias voltage to the toner according to the result of detection by said toner charged state detecting means.

29. An image forming apparatus according to claim 28, wherein said toner charged state detecting means detects the charged state of the toner accomodated in said toner accommodating means.

30. An image forming apparatus according to claim 28, wherein said toner charged state detecting means detects the charged state of the toner based on developed toner.

* * * * *

UNITED STATES PATENT AND TRADEMARK OFFICE

CERTIFICATE OF CORRECTION

PATENT NO. : 5,781,827

DATED : July 14, 1998

INVENTOR(S) : SHIMADA et al.

It is certified that error appears in the above-identified patent and that said Letters Patent is hereby corrected as shown below:

Col. 24, line 28: Delete "combination" and insert --combinations--

Signed and Sealed this

Seventeenth Day of November, 1998

Bruce Lehman

*Attest:*

BRUCE LEHMAN

*Attesting Officer*

*Commissioner of Patents and Trademarks*